US006533111B1

(12) United States Patent
Harden

(10) Patent No.: US 6,533,111 B1
(45) Date of Patent: Mar. 18, 2003

(54) PROTECTIVE, RE-ATTACHMENT KEY RING POUCH FOR KEY RING REMOTE DEVICES

(76) Inventor: Jackie Harden, 2608 S. Palm Ave., Ontario, CA (US) 91762

( * ) Notice: Subject to any disclaimer, the term of this patent is extended or adjusted under 35 U.S.C. 154(b) by 70 days.

(21) Appl. No.: 09/901,440

(22) Filed: Jul. 9, 2001

Related U.S. Application Data

(60) Provisional application No. 60/218,014, filed on Jul. 12, 2000.

(51) Int. Cl.[7] ..... A45C 11/32

(52) U.S. Cl. ..... 206/38.1; 70/456 R; 206/305

(58) Field of Search ..... D3/208; 70/456 R, 70/457–459; 206/37.1–37.8, 38.1, 305

(56) References Cited

U.S. PATENT DOCUMENTS 2,066,526 A * 1/1937 Gladstone ..... 206/37.4
4,789,573 A * 12/1988 Jenkinson ..... 70/456 R
5,722,277 A * 3/1998 Williams ..... 70/456 R
5,850,754 A * 12/1998 Dobbins ..... 70/456 R
5,873,456 A * 2/1999 Hull et al. ..... 206/38.1
6,224,258 B1 * 5/2001 Dodson ..... 383/9
D448,157 S * 9/2001 Wright ..... D3/208
D456,600 S * 5/2002 Gadson ..... D3/208

* cited by examiner

*Primary Examiner*—Jim Foster

(57) ABSTRACT

This is a protective pouch for key ring remote devices. The protective pouch will house and prevent a remote from detaching from a key ring or re-attach a remote that has already detached. This is due to the fact that the key ring will be swinging on the grommet and not on the loop on top of a plastic key ring remote housing. At the same time all function buttons will be visible through a clear vinyl window and the remote will work right through this universal pouch. It will provide protection for the function buttons, and against chipping. It will also provide some protection against moisture.

7 Claims, 2 Drawing Sheets

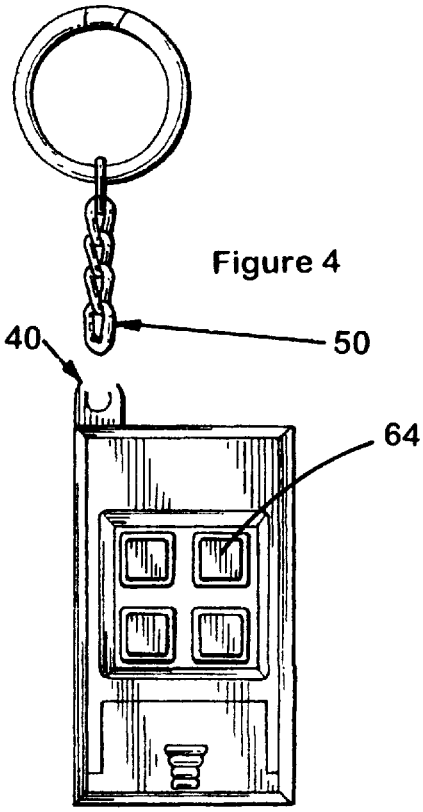
Figure 4
Figure 5
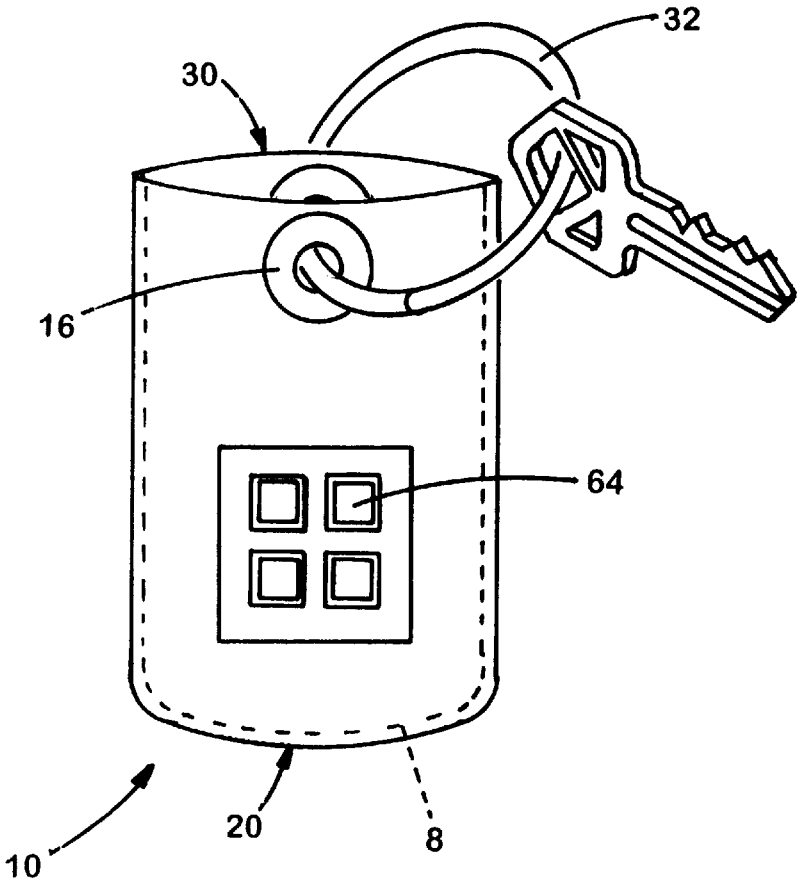

PROTECTIVE, RE-ATTACHMENT KEY RING POUCH FOR KEY RING REMOTE DEVICES

CROSS-REFERENCE TO RELATED APPLICATION

This application claims the benefit of Provisional Patent Application Ser. Nr. 60/218,014 filed Jul. 12, 2000.

FEDERALLY SPONSORED RESEARCH

Not applicable

SEQUENCE LISTING OR PROGRAM

Not applicable

BACKGROUND—Field of Invention

This invention relates to key ring remote control devices, specifically for protecting and re-attaching them back onto a key ring.

BACKGROUND—Description of Prior Art

At present, key ring remote control devices for car alarms, keyless entry homes or even some garage door openers are made with a plastic housing. They are all designed with a plastic loop at the top of the housing to allow it to be attached to a key ring.

One of the major problems with the housing is the plastic loop at the top where it attaches to the key ring. It has a tendency to wear completely away separating the remote from the key ring, sometimes resulting in the loss of a remote. This is caused by the remote swinging back and forth on the key ring causing a gnawing effect on the plastic loop. This is a random event and can occur in a reasonable short time. Another common problem with the plastic housing is when the key ring is dropped the remote has been known to break open or chip. Water is another disabling factor. While disarming a vehicle in the rain a remote can get wet leaving the remote unable to disarm the alarm.

Some of these problems for protecting key ring remotes have been addressed in prior art, such as U.S. Pat. No. 5,388,691 to White showing a protective case and U.S. Pat. No. 6,155,416 to Jaime showing a remote car alarm protective device.

While these devices do add some protection, their inventions were not directed at protecting the plastic loop at the top of the housing. They do nothing to protect it and lack the ability to re-attach a remote that has broken off a key ring.

Therefore it is understandable why the need for new and improved protective covers for key ring remote devices are needed. The present invention totally fulfills this need.

OBJECTS AND ADVANTAGES

Accordingly, several objects and advantages of my invention are:

(a) To provide a protective pouch that will re-attach a key ring remote device back on a key ring.

(b) To provide a protective pouch that will prevent a key ring remote device from breaking off a key ring.

(c) To provide a protective pouch that will prevent wear on the function button of a key ring remote device.

(d) To provide a protective pouch that will give some protection while operating a key ring remote device in the rain.

(e) To provide a protective pouch that will prevent a key ring remote device from becoming chipped when dropped.

(f) To provide a protective pouch in a variety of colors that will add fashion ability to a key ring remote device.

Still further advantages will become apparent with further consideration of description and drawings.

SUMMARY

The present invention contains a protective pouch composed of leather sides, a vinyl window and grommets located at the top, to allow a key ring to be inserted.

DRAWINGS

Drawing Figures

FIG. 4 is a view of a key ring remote that has broken off the key ring, to highlight the usefulness of this invention.

FIG. 5 is a front view of the protective pouch with the remote from FIG. 4 placed inside.

Reference Numerals In Drawings

| | |
|---|---|
| 4 | vinyl window |
| 8 | stitching |
| 10 | the present invention |
| 16 | ¼" grommet |
| 20 | front side |
| 30 | back side |
| 32 | steel key ring |
| 40 | broken remote |
| 50 | part of the broken remote |
| 64 | function buttons |

DETAILED DESCRIPTION OF THE INVENTION

Figure 1:
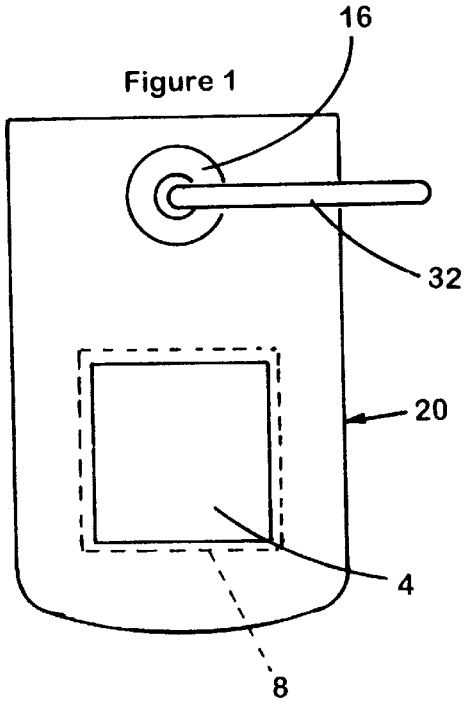
FIG. 1 is a front view of the protective pouch.
Figure 2:
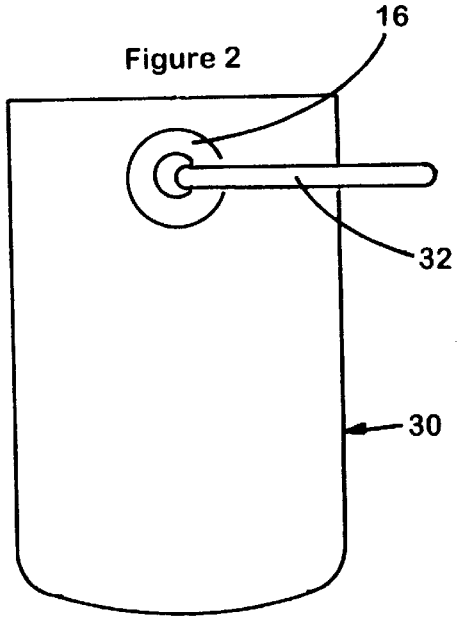
FIG. 2 is a back view of the protective pouch.
Figure 3:
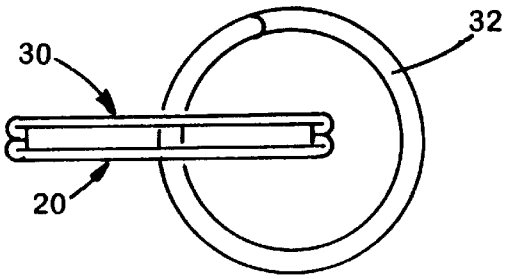
FIG. 3 is a top view of the protective pouch.

The present invention 10 (FIG. 5) is a protective pouch that will house a remote device 40 (FIG. 4). Front piece 20 (FIG. 1) rectangular in shape has a vinyl window 4 located in the lower section by means of stitching. The section of 20 has a grommet 16 that allows a steel key ring 32 to be inserted through the grommet 16. Back piece 30 (FIG. 2) also rectangular in shape has a grommet 16 located at upper section that allows a steel key ring 32 to be inserted through the grommet 16. Front piece 20 is attached to back piece 30 (FIG. 5) by means of stitching 8.

FIG. 4 is showing a remote 40 that has separated from the key ring 50 due to the broken loop 128 at the top of remote 40. This could have been caused by dropping the keys or from the remote 40 just swinging on the key ring 50.

FIG. 5 is showing the present invention 10 with a remote 40 inserted inside the protective pouch and reattaching it back to a key ring 32. It is also showing that the function buttons 64 of remote 40 can be seen while inside the protective pouch 10. Remote 40 will operate right through the protective pouch 10.

Now with the remote 40 placed in the present invention 10 (FIG. 5) it will never become separated do to the fact that the key ring 32 is swinging on the grommet 16 rather then the plastic loop 128 (FIG. 4). It will also prevent damage to the function button 64 while in the protective pouch 10.

I claim:

1. A protective pouch that will reattach a remote device of the type hanging on a key ring back onto the key ring, comprising of:

(a) a pouch with one opening in the top for receiving a remote device;

(b) said pouch having a front piece and back piece;

(c) front piece of said pouch containing a clear plastic window;

(d) grommets on front and back of said pieces;

(e) a steel key ring inserted through both of said grommets;

(f) said remote device located in said pouch; and (g) said grommets being laterally located on said pieces so as to prevent removal of said remote device by said key ring.

2. The protective pouch as described in claim 1 wherein the pouch has the ability to prevent a key ring remote device from falling off a key ring.

3. The protective pouch as described in claim 1 wherein the pouch provides protection for all the function buttons on key ring remote devices.

4. The protective pouch as described in claim 1 wherein the pouch provides some protection against moisture for key ring remote devices.

5. The protective pouch as described in claim 1 wherein the pouch provides protection from chipping a key ring remote device when dropped.

6. The protective pouch as described in claim 1 wherein the pouch will add some fashion ability to key ring remote devices.

7. The protective pouch of claim 1, wherein the lateral location of said grommets is one in which the grommets are centrally laterally located on their respective pieces.

* * * * *